United States Patent [19]

Harp

[11] Patent Number: 4,892,684

[45] Date of Patent: Jan. 9, 1990

[54] METHOD AND APPARATUS FOR SEPARATING RADIONUCLIDES FROM NON-RADIONUCLIDES

[76] Inventor: Richard J. Harp, 18746 Viking Way, Cerritos, Calif. 90701

[21] Appl. No.: 929,717

[22] Filed: Nov. 12, 1986

[51] Int. Cl.[4] ..... G21F 9/00

[52] U.S. Cl. ..... 252/626; 376/308

[58] Field of Search ..... 159/DIG. 12, 47.3; 202/175, 235; 252/626, 632; 376/308, 310; 110/237, 342

[56] References Cited

U.S. PATENT DOCUMENTS

| | | | |
|---|---|---|---|
| 1,943,106 | 1/1934 | Burnham | 202/175 |
| 3,404,722 | 10/1968 | Bloore | 159/DIG. 12 |
| 3,405,040 | 10/1968 | Ewald | 202/175 |
| 4,040,973 | 8/1977 | Szivós et al. | 376/308 |
| 4,095,307 | 6/1978 | Burbaker | 15/246.5 |
| 4,119,560 | 10/1978 | Sheeline | 252/301.1 W |
| 4,160,692 | 7/1979 | Mitchell et al. | 159/6 W |
| 4,178,105 | 12/1979 | Sollich | 366/312 |
| 4,243,636 | 1/1981 | Shiraki et al. | 422/225 |
| 4,276,834 | 7/1981 | Bregulla et al. | 110/237 |
| 4,279,692 | 7/1981 | Chino et al. | 159/6 W |
| 4,279,693 | 7/1981 | Kühnlein et al. | 159/47.3 |
| 4,383,888 | 5/1983 | Chino et al. | 159/49 |
| 4,447,293 | 5/1984 | Watanabe et al. | 159/6.2 |
| 4,499,833 | 2/1985 | Grantham | 252/632 |
| 4,526,712 | 7/1985 | Hirano et al. | 252/632 |
| 4,555,361 | 11/1985 | Buckley et al. | 252/632 |
| 4,564,507 | 1/1986 | Elliot | 252/626 |
| 4,655,968 | 4/1987 | Queiser et al. | 252/632 |
| 4,675,129 | 6/1987 | Baatz et al. | 159/DIG. 12 |
| 4,676,175 | 6/1987 | Ledebrink et al. | 110/237 |

FOREIGN PATENT DOCUMENTS 6114800 9/1981 Japan .

*Primary Examiner*—Deborah L. Kyle
*Assistant Examiner*—Richard W. Wendtland
*Attorney, Agent, or Firm*—Richard L. Myers

[57] ABSTRACT

In an apparatus for separating radionuclides from non-radionuclides in a mixture of nuclear waste, a vessel is provided wherein the mixture is heated to a temperature greater than the temperature of vaporization for the non-radionuclides but less than the temperature of vaporization for the radionuclides. Consequently the non-radionuclides are vaporized while the non-radionuclides remain the solid or liquid state. The non-radionuclide vapors are withdrawn from the vessel and condensed to produce a flow of condensate. When this flow decreases the heat is reduced to prevent temperature spikes which might otherwise vaporize the radionuclides. The vessel is removed and capped with the radioactive components of the apparatus and multiple batches of the radionuclide residue disposed therein. Thus the vessel ultimately provides a burial vehicle for all of the radioactive components of the process.

29 Claims, 4 Drawing Sheets

NITROGEN
PUMP
WATER
COOL WATER
WARM WATER
11
13
15
17
19
21
22
27
29
31
33
35
43
45
47
49
51
59
77
79
81
125
127
143
145
151
155
157
159
161
163
171
173
175
177
181
183
185
191
193
195
213
215
217

77
125
129
127
99
215
97
83
93
49
79
145
109
59
111
107
61
47
143
43
149
139
147
22
95
81
85
3
27
19
29
113
123
115
63
139
69
65
67
13
75
15
21
17

METHOD AND APPARATUS FOR SEPARATING RADIONUCLIDES FROM NON-RADIONUCLIDES

BACKGROUND OF THE INVENTION

The Government has rights in this invention pursuant to Purchase Order No. 2246201 under Contract No. W-7405-ENG-48 awarded by the U.S. Department of Energy.

1. Field of the Invention

The present invention relates generally to methods and apparatus for separating compounds having different vapor pressures, and more specifically, for non-destructively separating radionuclides from non-radionuclides in a generally oxygen free environment.

2. Discussion of the Prior Art

In the context of energy production, the advantages of nuclear power over more conventional systems are many. Perhaps most significant is the fact that radioactive materials are presently the earth's most concentrated energy source. Furthermore, with the advent of the breeder reactor, it would appear that man can produce an almost endless supply of radioactive fuel. Compared with fossile fuel energy production, nuclear power produces no combustion by-products which tend to effect ecological imbalances and interfere with the earth's delicate solar radiation blanket.

While the advantages of nuclear power are many, certainly there are disadvantages associated with this system of energy production. Paramount among these disadvantages are safety considerations associated with the disposal of nuclear waste after its value to the system has been depleted. This nuclear waste typically takes two forms, high level waste and low level waste. "High level nuclear waste" is the name generally given to spent nuclear fuel rods, while "low level nuclear waste" is the name generally given to all other radioactively contaminated materials.

Low level waste typically includes plastic outer garments as well as ion exchange resins and activated charcoal used in certain decontamination processes. Other low level waste materials may include plastic compounds used in some tanks as well as piping, cloth, etc. While appreciating that the radioactive levels of low level waste sometimes approach those of high level waste, nevertheless it is these low level waste materials which are particular interest to the present invention.

Low level waste is produced by a wide variety of sources. Among them are research institutions, hospitals, government or defense operations, and of course nuclear power generating sites. These sources generate an average of over three million cubic feet of low level nuclear waste each year. Disposal of this volume of radioactive material each year is of primary concern to the nuclear power industry.

Since there are only three radioactive waste dump sites in the United States, it can be appreciated that present methods for shipping radioactive waste are extremely complex and costly. Typical costs for the handling and disposal of low level nuclear waste at a single nuclear power plant can range to several million dollars per. Given this background it can be appreciated that systems for reducing the volume of low level nuclear waste are of critical importance to the nuclear power industry.

Waste pre-treatment in a volume reduction process serves to minimize the quantity of waste material to be solidified and shipped off-site. The primary advantage of a large volume reduction is the substantial savings in transportation and handling costs which can be enjoyed, along with reduced risk, when fewer shipments are required. Several types of volume reduction equipment are concerned with producing solids from waste material having a water content as high as 50–60% by weight. Various systems of this type include the fluid bed dryer system, the fluid bed incinerators/calciner system, and the crystallizer system.

All of these systems involve a combustion process wherein the waste material, including both radionuclides and non-radionuclides, is initially burned in an attempt to reduce its volume. Unfortunately, the oxydizing flame associated with this combustion has a temperature which is well above the temperature of vaporization for many of the radionuclides. As a consequence, these radionuclides undergo a phase change from the solid state, through the liquid state, to the vapor or gas state. Both non-radionuclide and radionuclide vapors pass through the combustion apparatus gradually cooling and collecting on the machinery leading to the exhaust system. Eventually this equipment becomes plated with these radionuclides.

While there may be an initial reduction in the volume of the waste material, ultimately the entire combustion apparatus becomes contaminated resulting in an even greated disposal problem. The highly radioactive large metal components of the combustion apparatus and subsystems become a permanent part of an ever growing radioactive junk pile which is typically stored onsite. At this location it consumes valuable space and must be shielded in order to minimize its danger to the power plant.

In addition to volume reduction, some systems of the prior art seek to render the waste material more stable for transportation and burial. It is appreciated that the residue of the combustion process includes many elements and compounds which are not stable. Attempts have been made to coat this material with calcium in order to increase its stability. Crystallizers have also been used in an attempt to hermetically seal the residue material. In both these cases however, additional material must be added to the residue prior to transportation and burial. This of course works against the initial objective of reducing the volume of the waste.

While the systems discussed above provide for some reduction in the volume of non-radionuclides, they are concerned primarily with reducing the volume of the total waste. There is no attempt to separate the radionuclides from the large volumes of associated or bulky non-radionuclides. Only a process with this goal can produce the ultimate reduction in volume as it separates the harmful material which must be transported and buried, from the harmless material which can remain to be recycled.

SUMMARY OF THE INVENTION

The present system is designed not merely to reduce volume but to separate waste into a large but harmless volume on the one hand, and an extremely small but concentrated radioactive residue on the other hand. The residue which is ultimately buried contains radionuclides in the presence of only carbon. This element can not be further reduced and therefore is highly stable. No additional material need be added to the low-volume residue to inhance its stability for burial.

Accordingly a system is provided for reducing the volume of low level nuclear waste by as much as 90%. This system converts large volumes of low level nuclear waste into very small volumes of radionuclides, and a large volume of harmless oily liquid which can be disposed of or recycled back to the manufacture of the original material. This apparatus will process the nuclear contaminated protective suits and garments made from rubber and plastic compositions, but also, importantly, the plastic resin ion-exchange beads used to filter radionuclides from water.

In accordance with this invention, a separation apparatus or reactor, includes wall members defining a chamber which is adapted to receive and hold a mixture of the radionuclides and non-radionuclides. Coils for heating the chamber are provided along with a stirring mechanism for subjecting the mixture within the chamber to centrifugal force.

It is important throughout the entire process that the temperature of the chamber be maintained at a level above that of the temperature of vaporization of the non-radionuclides, but less than that of the temperature of vaporization for the radionuclides. This is preferably accomplished in an oxygen free environment in order to avoid the possibility of explosion or catalytic action between the radionuclides and non-radionuclides. The means providing a centrifugal force constantly stirs the contents of the chamber and facilitates maintenance of a constant temperature throughout the contents of the chamber.

A condenser is provided to liquify the vaporized non-radionuclides into a harmless oily substance which can be recycled. Only the potentially harmful radionuclides, with a volume of perhaps only 10% of that of the original low level waste, remain in the chamber for ultimate disposition. These remaining radioactive particles can be removed for storage on-site until future batches of the process result in enough waste to justify transportation to a disposal site.

At this point, it is apparent that the separation apparatus will have processed many batches of low level nuclear waste and portions of the apparatus will have therefore become radioactive. These portions will include not only the chamber walls but also the stirring mechanism. With an appropriate disconnect structure, the chamber and elements can be removed from the remaining portion of the separation apparatus and the chamber can be filled with the low volume, previously processed radionuclides. Thus the chamber becomes a burial vehicle, filled only with the solid nuclear waste, that can then be easily and economically transported to an off-site disposal station. A replacement, disposable chamber can then be easily assembled to the other, non-radioactive components of the reactor.

It can be appreciated that the apparatus and methods associated with this invention solve a paramount problem associated with the disposal of low level nuclear waste. By separating the harmful radioactive material from the harmless non-radioactive material, the volume to be disposed of is significantly reduced. The ability to remove the chamber and stirring mechanism from other portions of the reactor, facilitate their removal to a burial site along with the radioactive residue. Thus, the radioactive chamber provides an excellent vehicle and burial mechanism for the processed radioactive material.

While this system for separating radionuclides from non-radionuclides is partioularly advantages with respect to materials derived from a fission reactor system, the process is equally adapted to separate radioactive components from clothing and even from organic materials such as food substances. These and other features and advantages of the system will become more apparent with a description of preferred embodiments and reference to the associated drawings.

BRIEF DESCRIPTION OF THE DRAWINGS

The accompanying drawings, which are incorporated in and form a part of the Specification, illustrate many embodiments of the invention, and, together with the Description, serve to explain the principles of the invention.

DESCRIPTION OF PREFERRED EMBODIMENTS

The present invention provides an apparatus for separating radionuclides from non-radionuclides, and includes a separation vessel having wall members defining a reactor chamber adapted to receive a mixture of the radionuclides and non-radionuclides. Means for heating the chamber in a substantially oxygen free environment, as well as means for subjecting a mixture disposed within the chamber to centrifugal force, are included. Means for removing non-radioactive vapors formed within the chamber are ultimately provided along with means for condensing those vapors.

The method of the present invention for separating radionuclides from non-radionuclides includes the steps of providing a separation apparatus including wall members defining a reactor chamber, and means for heating the chamber in a substantially oxygen free environment. The chamber is adapted to further include means for subjecting the mixture disposed therein to centrifugal force. The chamber is heated to a temperature greater than the temperature of vaporization of the non-radionuclides, but less than the temperature of vaporization of the most volatile radionuclides. Thus the non-radionuclides undergo a phase change to a vapor state while the radionuclides remain in a solid or liquid state. Upon cooling, the vaporized non-radionuclides liquify to provide an oily substance while the radionuclides solidify for ultimate burial.

Figure 1:
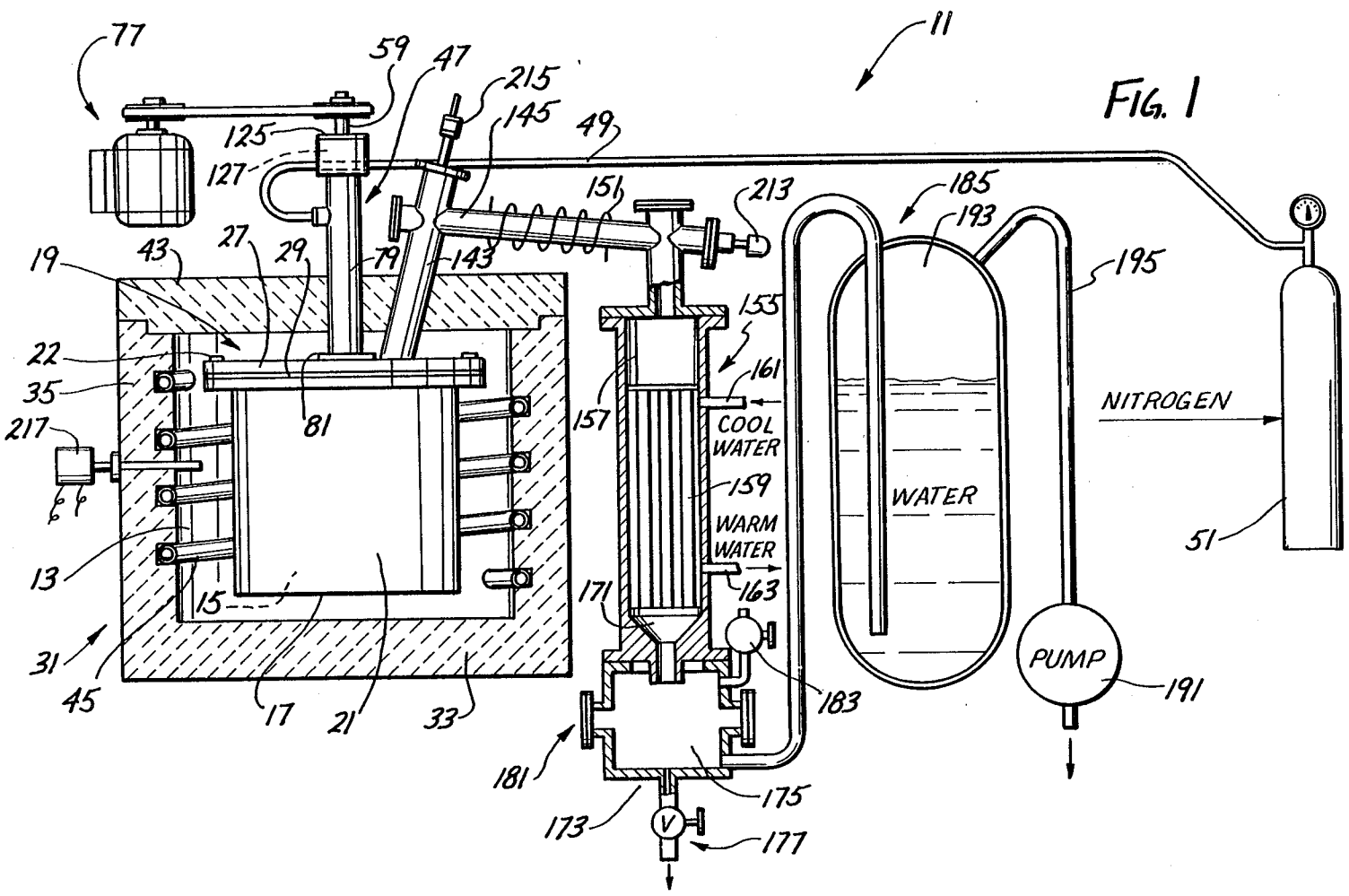
FIG. 1 is a schematic view of one embodiment of an apparatus for separating radionuclides from radionuclides in accordance with the present invention.

Referring now to FIG. 1, a separation apparatus 11 includes a reactor vessel 13 defining a reactor chamber 15. The vessel 13 has a generally cylindrical configuration, and the chamber 15 is defined by a bottom wall member 17, top wall members shown generally at 19, and a side wall member 21. This side wall member 21 has an interior surface 23 of particular interest to the present invention.

The top wall members 19 include a top plate 27 and a subplate 29 both of which are removably attached to the side wall membars by a plurality of bolts 22. A seal ring (not shown) is disposed between the wall members 19 and the side wall member 21 to effect a tight seal.

Included in the separation apparatus 11, in surrounding relationship to the chamber 15, is a furnace assembly 31 having a bottom section 33, a side section 35 and a top section 43. This assembly 31 provides heat substantially uniformly to the walls 17–21 by way of a heating coil 45 which may be embedded in the side section 35.

In order to enhance uniform heating of the reactor vessel 13, in one embodiment of the invention the vessel 13 is provided with a substantially cylindrical configuration and the furnace assembly 31 has a geometric configuration, such as octagonal, which closely approximates the geometry of the vessel 13. Application of uniform heat minimizes the formation of overheated or underheated temperature zones within chamber 15. A suitable furnace assembly 31 includes an electric furnace coil 45 which is regulated by solid state temperature indicators and the like.

Extending through the top wall members 19 is a shaft assembly 47 which is connected to a gas supply line 49. Together, these components serve to introduce a non-combustible gas, such as nitrogen, into the chamber 15.

A nitrogen source 51 is operatively connected to the gas supply line 47 and serves to initially purge the chamber 15 of oxygen. This provides a substantially oxygen.-free environment within which the non-radionuclides can be vaporized. In the absence of oxygen, there is no opportunity for explosion. In addition, oxygen is not present to catalyze the formation of various compounds as the non-radionuclides vaporize. Thus the radionuclides and non-radionuclides can be maintained fairly distinct with their temperatures of vaporization widely separated.

The wall members 17–21, as well as other assembly parts of the apparatus, are suitably formed of any material which is resistant to the corrosive effects of the radionuclides and can withstand the high temperatures necessary to vaporize the non-radionuclides. Suitable materials include stainless steel and, in a preferred embodiment, the alloy inconel.

Figures 2, 3:
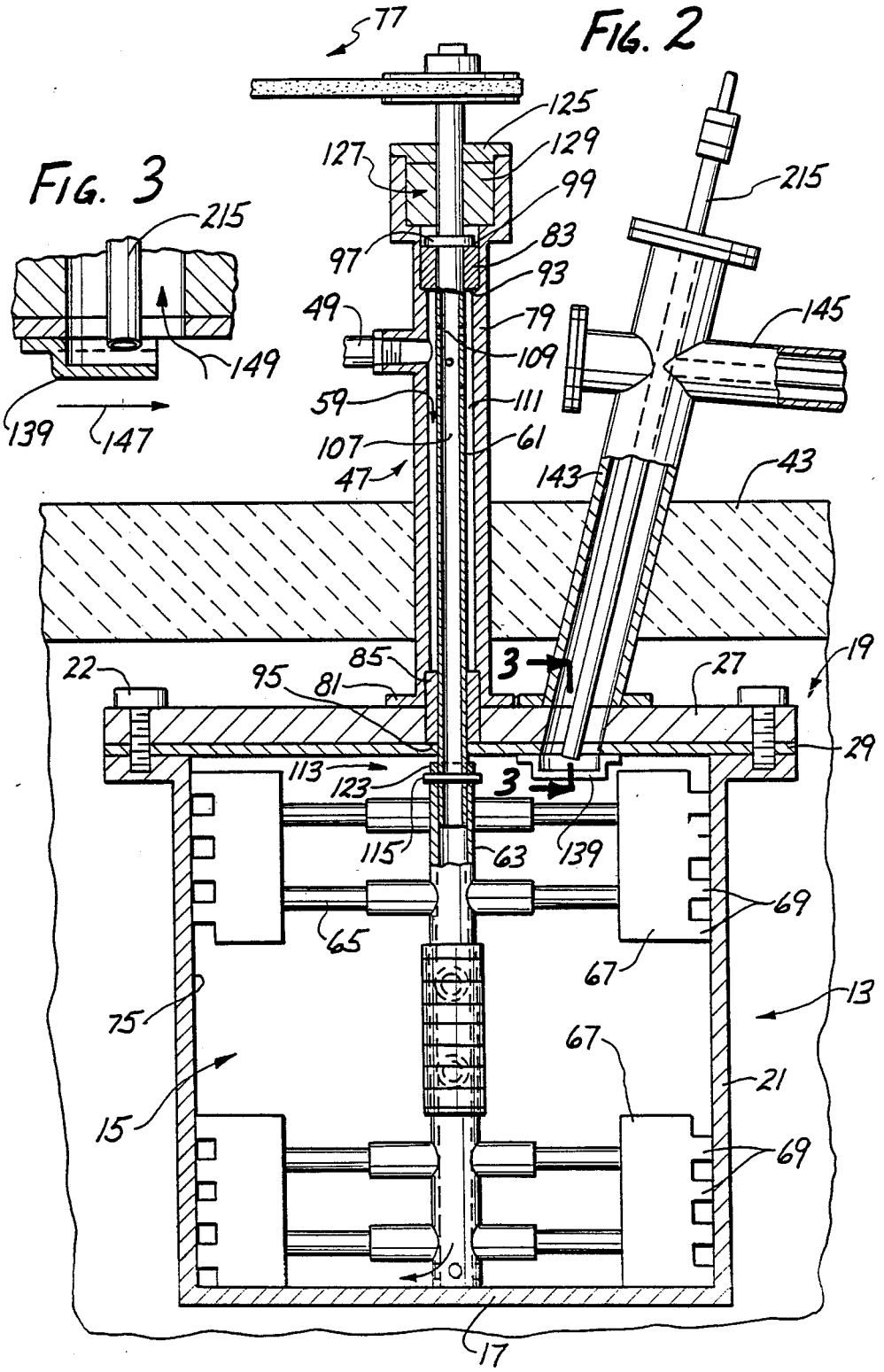
FIG. 2 is a cut away view of the interior of the separation vessel of FIG. 1 and the suspension and rotation mechanism associated with the vessel.
FIG. 3 is a cross-sectional view of a vapor outlet baffle taken along lines 3—3 of FIG. 2.

A stirring mechanism for subjecting the contents of the reactor to centrifugal force, is best illustrated in FIG. 2 where the vessel 13 is shown in greater detail. In one embodiment of the invention, the stirring mechanism comprises a shaft 59, rotatably mounted within the shaft assembly 47 for rotation within chamber 15. The shaft 59, which may include an upper shaft section 61 and a lower shaft section 63, is equipped with a plurality of arms 65 which extend radially outwardly from the shaft 59 to support respective blade members 67 which are slidably mounted on the arms 65.

The blade members 67 are free to move in an outward direction to contact the side wall member 21 and thereby conduct heat generated by the furnace assembly 31 into the chamber 15. Thus the blade members 67 are preferably made of a good heat-conducting material, such as numerous copper alloys.

The outward movement of the blades 67 operates to position these blades 67 adjacent to the side wall member 21; in fact, in a preferred embodiment these blades 67 actually ride on the wall member 21 as they rotate about the chamber 15. Thus the rotational movement of the shaft 59 and the blades 67 imparts a stirring action to centrifugate the mixture within chamber 15. This centrifugation tends to move the heavier radionuclides toward the wall member 21 while the lighter non-radionuclides tend to seek a more central location. From this interior position, the non-radionuclides, in the presence of a temperature exceeding their temperature of vaporization, transpose to a gas phase and exit the chamber 15.

As this vaporization takes place, some of the material in the chamber begins to form carbon. This is most noticeable on the interior surface 23 of the side wall member 21 and on the outer layer of the particles in the chamber 12. This carbon tends to have an undesirable insulating effect which isolates the mixture from the heat. Thus, carbon on the interior surface 23 tends to insulate the inner regions of the chamber 15 from the higher temperature of the walls 21. Similarly, the carbon forming on the outer layer of the particles tends to insulate the material on the inside of these particles.

The action of the blades 67 in combination with the wall member 21 resist both of these insulating effects. As the blades 67 spin within the chamber 15, they wipe against the wall member 21 and scrape this carbon insulation from the walls. This action, which reduces the insulative effect of the carbon on the walls, tends to maintain a fairly uniform temperature gradient from the walls 21 to the center of the chamber 15. Also contributing to this advantageous uniform temperature gradient, is the high heat conductivity of the material forming the blades 67 which facilitates the transmission of heat from the walls 21 into the chamber 15.

The blades 67 In combination with the wall members 21 also tend to break the particles up so that the interior regions of these particles are no longer insulated by their exterior carbon layer. To further facilitate this particle breakup, the blade members 67 can be provided with a plurality of teeth 69 along the surface which contacts the wall member 21.

Figure 5:
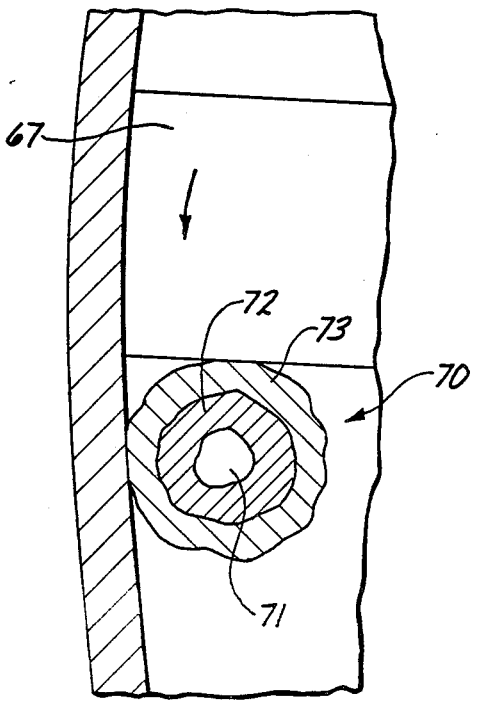
FIG. 5 (PRIOR ART)
FIG. 5 is a top plan view of a chamber wall and stirring mechanism associated with reactors of the prior art.
Figure 6:
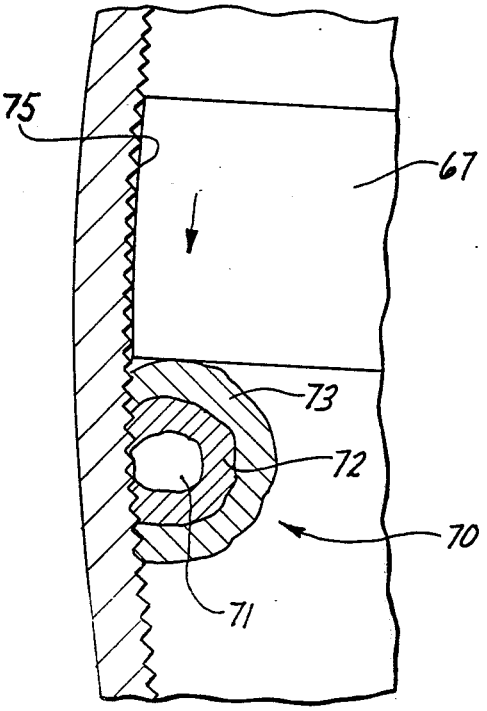
FIG. 6 is a top plan view of a chamber wall and stirring mechanism which facilitates particle dynamics in the present invention.
Figure 7:
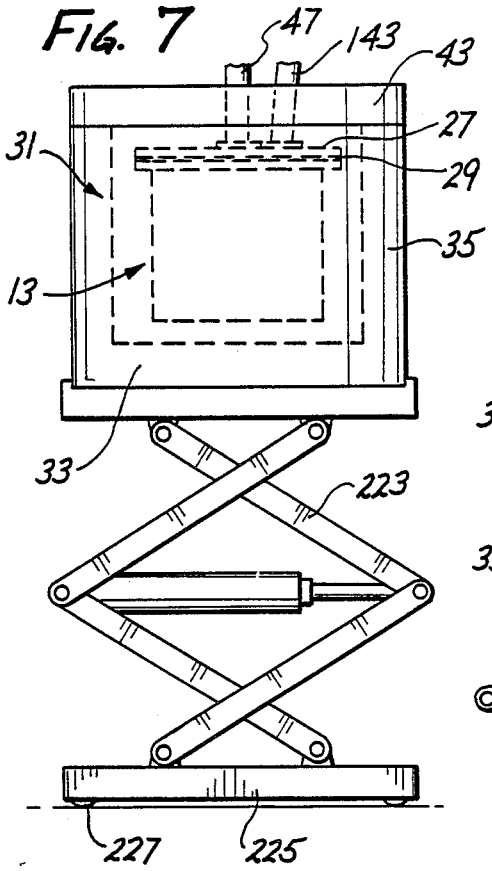
FIG. 7 is a side elevation view of a hydraulic mechanism facilitating disassembly of the reactor associated with the present invention.

The importance of this concept of the present invention can best be appreciated with reference to FIGS. 5 and 6. FIG. 5 illustrates a particle 70 which might be disposed in a reactor chamber of the prior art. As heat is applied to the chamber, the particle tends to form into an inner core 71, and intermediate layer 72, and outer layer 73. The inner core 71 is in a substantially solid state while the intermediate layer 72 is in a more liquid state. The outer layer 73 comprises a layer of carbon which has a highly insulative effect on the more interior layers of the particle 70.

In centrifuge apparatus of the prior art, the sidewall has been provided with a relatively smooth inner surface so that the wiping action of the stirring mechanism merely tends to roll the particle along the outer wall. This rolling action forms the particle 70 into a spherical shape, compacting and concentrating the outer carbonized layer 73. Under these circumstances, the inner core 71 and intermediate layer 72 of the particle 70, never see the higher heats present in the reactor chamber. In such an apparatus, much higher heats would have to be applied in order to vaporize the non-radionuclides. These higher temperatures of course risk vaporization of the radionuclides.

It will be noted that as this particle 70 approaches a spherical shape, it becomes dynamically stable with its greatest mass and density at its geometric center. The particle becomes even more stable as it continues to roll along this smooth sidewall of the prior art, enhancing its spherical shape.

As illustrated in FIG. 6, the blades 67 of the present invention are permitted to contact and severely score the interior surface of the sidewalls 21. In this manner, score grooves 75 are created which oppose the simple tumbling action of the particle 70. Thus when the particle is caused to travel tangentially along the wall 21, but with high centrifugation, it is simultaneously abraided by the continuously cleaned and freshly scored grooves 75 in the wall 21. Thus the particle is immediately worn on the one side.

This uneven abraiding action creates an instability in the particle causing its center of gravity to move from its geographic center. Thus the particle begins to tumble so that its center of mass moves in the direction of the centrifugal force. This brings other portions of the carbonized outer layer 73 into contact with the score grooves 75 in the wall 21 so that this layer is ultimately removed from the particle.

As the unstable particle 70 is wiped across the radial path, the various zones of material are reduced to dust size particles. These particles, which contain carbon, act as a partial lubricant to slow the metal to metal wear between the blades 67 and the walls 21. Nevertheless, this wear is permitted to occur as an aid to particle dynamics, since ultimately the reactor chamber 12 will be disassembled for burial with the radionuclide residue resulting from multiple batches of the process.

In the illustrated embodiment, the blade members 67 are provided in pairs which are disposed on opposing pairs of the arms 65. Each pair of the blade numbers 67 is provided with teeth 73 which are offset so that the combined sweeping action of the two blades in each pair cover an entire area of the wall member 21. Additionally, each blade pair slightly overlaps with other blade pairs in order to insure that the entire surface of the wall member 21 is swept in a single revolution of the shaft 59.

In FIG. 2, the chamber 15 is illustrated with a centrifugal force means or stirring mechanism in an operational mode, i.e., the shaft 59 is rotating relative to the wall members 15–21. This rotation of the shaft 59 can be achieved by a gear motor drive 77 or other suitable driving mechanism. As the shaft 59 rotates about its longitudinal axis in the chamber 15, the blade members 67 tend to slidably move along their respective arms 65 outwardly toward the wall member 21. As this rotational movement increases, the blade members 67 move further toward the wall member 21 and preferably contact the wall member 21 in order to wipe away any accumulation on the interior surface.

The shaft assembly 47, as best is illustrated in FIG. 2, includes a shaft housing 79 having an outwardly extending cylindrical flange 81 which is welded or otherwise joined to the outer top plate 27. A pair of bearings 83, 85 register with respective shoulders 93, 95 on the interior surface of the shaft housing 79 to support the shaft 59. The bearings 83, 85 are preferably formed from a material such as carbon, which can withstand the temperatures present in the chamber 15. A cylindrical flange 97 extends radially outwardly of the shaft 59 and rests on the bearing 83 to form a seal 99.

In a preferred embodiment, the shaft 59 has a longitudinal bore 107 which extends through the bottom of the shaft 59 and into the chamber 15. A plurality of holes 109 can be drilled to extend between the bore 107 and a cavity 111 defined by the housing 79, the bearings 83, 85, and the shaft 51. It is this cavity 111 which is coupled through the gas supply lines 49 to the nitrogen source 51. With this structural configuration, nitrogen can be supplied by the source 51, through the line 49, into the cavity 111, through the holes 109 and down the bore 107 into the chamber 15.

In the illustrated embodiment, the upper shaft section 61 is operatively associated, through a quick disconnect assembly 113, with the lower shaft section 63 disposed within the chamber 15. The disconnect assembly 113 includes a pin 115 which is fixed to the upper shaft 61 and extends radially outwardly to couple with a pair of upwardly opening slots 123 in the bottom shaft 63. As described in greater detail below, this quick disconnect assembly 113 permits the radioactive components associated with the chamber 15 to be disassembled from the remaining portions of the processor for removal and ultimate burial.

The flange 97 is welded to, and extends radially outwardly from, the upper shaft section 61. This flange 97 rests upon the upper surface of the bearing 83 and forms the seal 99 therebetween. The effect of this seal 99 is greatly enhanced by the fact that the entire weight of the shaft 59 and the stirring assembly, including arms 65 and blade members 67, is supported at the interface between the flange 97 and the bearing 83. It is the purpose of this seal 99 to prevent the escape of any radioactive material upwardly along the shaft 59.

As a back up system for this seal 99, the shaft housing 79 can be enlarged above the bearing 83 and provided with a screw cap 125, to define with the bearing 83 and the cap 125, a stuffing cavity 127. Carbon impregnated stuffing material 129 can be disposed interiorly of this cavity 127 to capture radioactive particles on the remote possibility that they would escape beyond the seal 99. This back up system adds to the safety factor associated with the present invention.

Referring again to FIG. 1, it will be noted that vapors originating in the chamber 15 flow from the chamber through a reverse flow baffle 139, a vapor line 143, a condenser receiver line 145, and into a condenser assembly 155. These vapors are removed from chamber 15 by the application of a slight vacuum such as 45–79 inches of water.

The reverse baffle 139 is best illustrated in FIG. 3. In this embodiment, the blades 67 are provided with a clockwise rotation (as viewed from the top of chamber 15). In FIG. 3, this rotation is in the direction of an arrow 147. With this rotation, it is desirable that the baffle 139 open in the downstream direction. This insures that any particles or gases passing from the chamber 15 must reverse their normal direction in order to enter the vapor line 143. In FIG. 3, an arrow 149 illustrates this gas path. Since particulate matter is heavier than the exiting gases, it will be less capable of reversing direction. Thus the baffle 139 practically insures that the only substance entering the vapor line 143 is in a vapor state.

It may also be desirable to provide the vapor line 143 with a slope, such as 85 degrees, relative to the top wall member 19. This slope will facilitate the washing of small radioactive particulates on the remote possibility that they would travel up and into the vapor line 143 along with the hot, high velocity gases emanating from the reactor chamber 15.

The condenser receiver line 145 is preferably heated, for example by an externally wrapped heating element 151, and insulated. In a preferred embodiment, the line 145 is positioned with a downward slope in the forward direction of about 5 degrees.

The condenser assembly 155 consists of a primary chamber 157 and a plurality of vertical condensing tubes 159. A suitable coolant, such as water, can be introduced into the primary chamber 157 through a cool water inlet 161 and withdrawn from the chamber 152 through a warm water outlet 163.

Positioned below the condensing tubes 159 is a funnel 171 which gathers the droplets of condensate from the condenser assembly 155 and directs them into a liquid receiver assembly shown generally at 173. This assembly 173 provides a chamber 175 which collects the oil condensate and discharges that collection through a valved outlet 177.

The liquid receiver assembly 173 is also provided with a sight glass 181 and a fresh air inlet 183. The sight glass 181 provides means for observing the condensate flow and thereby determining when that flow is slowing. Due to the high temperatures within the condenser assembly 155, vision-blocking water droplets would normally form on the sight glass 181 were it not for the fresh air inlet 183. This inlet 183 provides cool ambient air in proximity to the sight glass which prevents water droplet formation and thereby facilitates a clear view of the condensate flow.

Optionally included is a water bath filter tank assembly 185 which provides a volume of water to purge exhaust gases and particulates for collection, measurement, and observation. This filter tank assembly 185 includes a vacuum pump 191 which draws a negative pressure on a vacuum chamber 193. A vacuum line 195, which provides communication between the liquid receiver chamber 173 and the vacuum chamber 193, should be terminated below a suitable level of cooling water within the vacuum chamber 193. Thus the filter tank assembly 185 not only contributes to condensate filtration but also provides the system with a source of negative pressure. This vacuum aids in vaporization of the non-radionuclides and also provides a prime mover for the vapor through the condenser assembly 155 and the water bath filter tank assembly 185.

Figure 4:
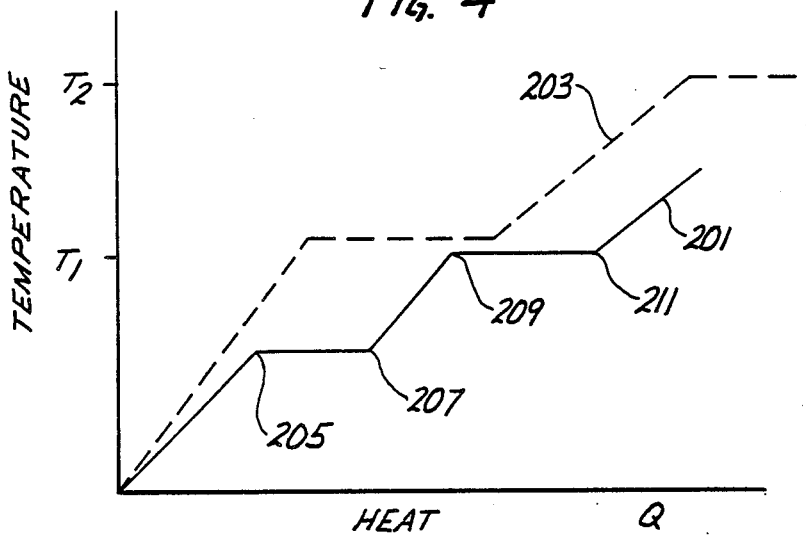
FIG. 4 is a graph of temperature versus heat illustrating the phase change relationships of the radionuclides and non-radionuclides.

The importance of maintaining the temperature of the chamber 15 within the confines of a particular temperature range can best be appreciated with reference to FIG. 4. This figure illustrates a graph of temperature plotted against heat for a particular substance. In this case, the solid line 201 represents the non-radionuclides in the instant process while the dotted line 203 represents the radionuclides in the instant process.

With reference to the solid line 201 only, it will be noted that this line is defined generally by four points designated with consecutive even reference numerals between 205 and 211. Between the origin and the point 205, the non-radionuclides are in a solid state and their temperature is rising linearly as heat is applied. Between the points 205 and 207, the temperature remains relatively constant as further heat is applied, and the substance undergoes a phase change from the solid to the liquid phase. This line defined by the points 205 and 207 is generally horizontal indicating that the phase change occurs at a constant temperature which is commonly referred to as the temperature of liquification. The quantity of heat applied at this constant temperature is referred to as the latent heat of liquification.

Between the points 207 and 209, the liquid substance rises in temperature as additional heat is applied. At the point 209, a constant temperature $T_1$ is maintained as heat is applied and the substance changes phase from a liquid to a vapor or gas state. The temperature $T_1$ is referred to as the temperature of vaporization and the amount of heat applied at this constant temperature $T_1$ is referred to as the latent heat of vaporization. Additional heat applied beyond the point 211 begins to raise the temperature of the already vaporized substance. In this stage it is said to be superheated.

This same phenomena applies to the substance forming the radionuclides as represented by the dotted line 203. In this case, the latent heat of vaporization occurs at a much higher temperature $T_2$. Thus the radionuclides remain in a liquid state until the temperature rises above $T_2$. It can be seen that if the goal of the instant process is to vaporize the non-radinuclides while maintaining the radionuclides in a solid or liquid state, then the temperature of the reactor chamber 15 should be maintained between the temperatures $T_1$ and $T_2$ corresponding to their respective temperatures of vaporization.

As the process initially begins, this temperature maintenance is of no particular problem and can be monitored with appropriate thermocouples, such as those designated by the reference numerals 213, 215 and 217. However, as the process proceeds and all of the non-radionucliees become vaporized, there is no material available in the chamber 15 that can absorb additional heat at the constant temperature of vaporization $T_1$. Even if one were to monitor the thermocouples 213–217 for a temperature rise, and turn off the furnace coil 45 accordingly, there could be enough residual heat in the entire system to create a heat spike and drive the temperature of the chamber 15 above $T_2$. This, of course, is to be avoided as some of the radionuclide material would then be vaporized.

It is this fact that makes the sight glass 181 particularly desirable. By merely monitoring the flow of condensate through the sight glass 181, the furnace coil 45 can be rurned off when the condensate flow begins to slow. This should leave a small amount of non-radionuclide material within the reactor chamber 15 to absorb any residual heat which might remain in the processor. Thus the sight glass 181 provides means for preventing a temperature rise above the temperature $T_2$ which corresponds to the latent heat of vaporization for the radionuclides.

As a further attempt to maintain even heat distribution and temperature control, it is important that no portion of the heat element 45 be disposed below the bottom wall member 17 or above the top wall member 27.

Once a particular batch of the material has been fully processed and substantiality all of the non-radionuclides have been vaporized, only the radionuclide residue remains within the chamber 15. Importantly, the volume of this material has been reduced by as much as 90% over that of the original bulk material. At this point the furnace assembly 31 can be opened along with the reactor vessel 13 to remove this small quantity of radionuclide residue for temporary storage on-site. A new batch of the bulk material can then be introduced into the chamber 15 and processed accordingly.

As illustrated in FIGS. 7–10, after several batches of the material have been processed, the reactor assembly 15 can be removed from the furnace assembly 31 and the more radioactive components of the system can be removed from the remainder of the processor for final disposition and burial off site. These more radioactive components include the chamber walls 17, 21 and 29 as well as the stirring assembly including the bottom shaft 63, the arms 65 and the blades 67.

It is of particular advantage that the reactor associated with the present invention can be disassembled by remote control to provide a burial vehicle not only for the several batches of radionuclide residue but also for the various components of the reactor which have become radioactive. This disassembly and preparation for burial is best illustrated in FIGS. 7–10.

Figure 8:
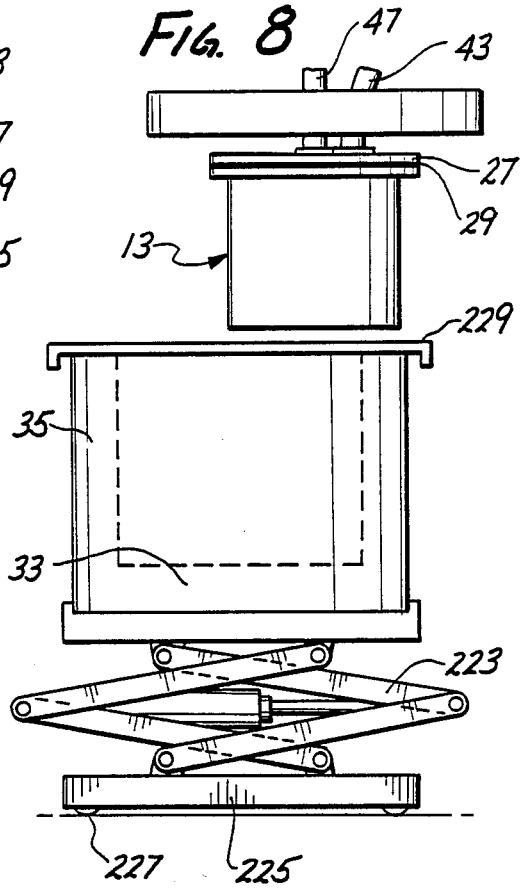
FIG. 8 is a side elevation view of the hydraulic mechanism in a lower position exposing the reactor vessel of the present invention.

In the illustrated embodiment, the furnace assembly 31 is supported on a hydraulic scissor jack 223 which is remotely operable to raise and lower the bottom wall and sides of the furnace assembly 31. The scissor jack 223 can be mounted on a platform 225 which is laterally moveable on rollers 227. As the scissor jack 223 is lowered, the side section 35 of the furnace assembly 31 separates from the top section 43 to expose the reactor chamber 15 inside. This condition is best illustrated in FIG. 8. When the side section 35 of the furnace assembly 31 has cleared the bottom wall member 17 of the vessel 13, a support plate 229 can be placed over the open furnace assembly 31. This support plate 229 not only insures that foreign particles do not enter the furnace assembly, but also provides a surface for supporting the weight of the reactor chamber 15. Thus initially the furnace assembly 31 is lowered, than the support plate 229 is placed over the furnace assembly 31, and the assembly 31 and the plate 229 are raised to support the reactor chamber 15.

At this point, the bolts 22 securing the top wall members 19 to the sidewall member 21 can be removed. When the scissor jack 223 is again lowered, the two top plates 27 and 29 separate from each other and the sub plate 29 lowers with the reactor assembly 15. It is this sub plate 29 which will aid in preventing any radioactive particulate matter from escaping during the disassembly process.

Figure 9:
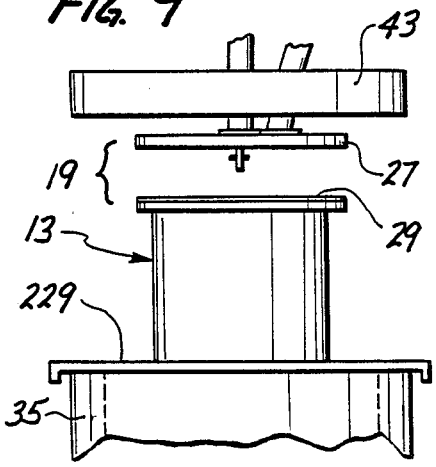
FIG. 9 is a side elevation view of the reactor partially disassembled from its supporting mechanism.
Figure 10:
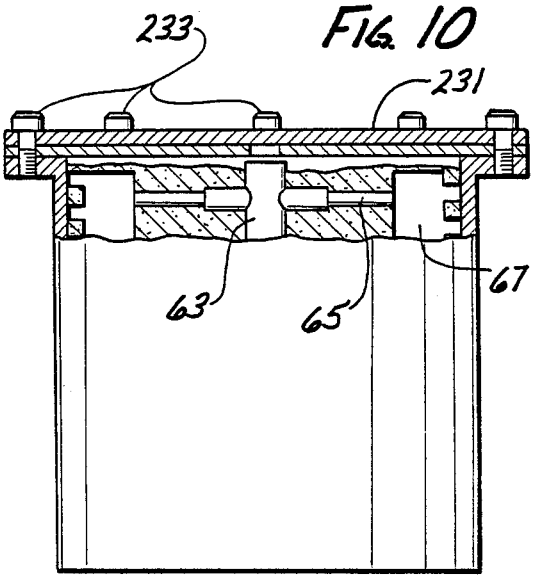
FIG. 10 is a side elevation view partially in phantom of the reactor, stirring mechanism, and the radioactive residue suitably capped for transportation and burial.

This stage of the process is illustrated in FIG. 9 where it will be noted that the upper shaft section 61 has separated from the lower shaft section 63 at the quick disconnect 113. Thus the lower shaft 63, the arms 65, and the blades 67 are suitably encased within the reactor chamber 15 for burial. These elements comprise the only components of the system which have achieved any substantial degree of radioactivity.

As a final step in the disassembly and burial process, the radionuclide residue from prior batches of the process can be loaded into the reactor chamber 15 for ultimate burial. This residue can be loaded through the hole in the sub-plate 29 which was vacated by the top shaft section 61. In this manner, the sub-plate 29 need not ever be removed from the reactor vessel 13.

Finally, in order to ultimately seal the reactor chamber 15 for burial, a cover plate 231 can be secured over the top plate 29 to the sidewalls 21 by a plurality of screws such as those illustrated at 223. In this configuration, all of the radioactive material resulting from the process is neatly packaged and sealed in a single container which can be easily transported and buried off site.

Thus the reactor vessel 13 ultimately provides the burial vehicle not only for the radioactive residues which result from the process, but also for those components of the assembly which themselves become radioactive.

The method of the present invention is carried out with the apparatus disclosed in FIGS. 1 and 2. After the bulk material including radionuclides and non-radionuclides is introduced into chamber 15, nitrogen is caused to flow into the chamber to purge it of oxygen. In this manner, the process is non-oxidizing and nondestructive. Depending upon the radionuclides present, the most desirable temperature for the chamber 15 may vary. Thus, the method of the present invention is applicable for separation of all radionuclides, depending upon their vaporization temperature relative to the vaporization temperature of the non-radionuclides. For purposes of illustration, the vapor temperatures of Am, Pu, Sr and Ce are listed in Table I.

TABLE I

| Radionuclide | Vaporization Temperature |
|---|---|
| Am | 4724° F. |
| Pu | 5849° F. |
| Sr | 2523° F. |
| Ce | 1253° F. |

For effective separation of non-radionuclides from radionuclides, the temperature can not exceed the lowest vaporization temperature of the radionuclides. Specifically for the four nuclides listed in Table I, the reactor chamber 15 can be heated to a temperature below about 1253° F. This achieves a selective vaporization of the non-radionuclides without effecting a phase change in the radionuclides which may have a temperature of vaporization of about 900° F. The greater the gap between the vaporization temperatures of the radionuclide and non-radionuclide material, the cleaner the separation for a given centrifugation. The closer the vaporization temperatures of the highest temperature non-radionuclide to the lowest temperature radionuclide, the greater the need for even heat distribution throughout the separation vessel. In addition to the other means for effecting heat control, it has been found that a faster rate of stirring tends to enhance even heating.

The amount of centrifugal force applied to the mixture and the temperature at which the mixture is agitated can be controlled in accordance with the difference between the vaporization temperature of the radionuclides and the vaporization temperature of the non-radionuclides in the bulk material. Generally, the greater this difference the smaller the amount of centrifugal force that need be applied.

After the mixture of radionuclides and non-radionuclides has been introduced into the reactor chamber 15, the chamber is heated while the shaft 59 is caused to rotate. As a result of the centrifugal force generated, blade members 67 are caused to push in an outward direction and ride on the interior wall surface 23 of the chamber 15. The teeth 69 of each blade member 67 cut through the material disposed within chamber 15 as well as by-products which are formed. Blade members 67 pick up heat from the furnace assembly 31 via the wall members 21, and transfer it to the material disposed within the chamber. The temperature of chamber 15 is maintained at a level which does not exceed the vaporization temperature of the radionuclides of interest. Rotation of blade members 67 within chamber 15 circulates the bulk material within the chamber, and this, along with the high temperature, results in vaporization of the non-radionuclides without effecting a phase change in the radionuclides.

The residence time of the mixture within the chamber also varies dependent upon the mixture. As the amount of mixture disposed within the chamber increases, the residence time also increases.

Vaporized non-radionuclides flow from chamber 15 through the vapor line 143, condensate receiver line 145, and then into condenser assembly 155 where a lower temperature results in condensation of the vaporized non-radionuclides.

The following examples are illustrative of the present invention, and are not to be regarded as limiting its scope, which is defined in the appended claims.

EXAMPLE I

Coconut material, which is contaminated with various radionuclides of Ce, is shredded and placed in the apparatus illustrated in FIGS. 1 and 2. The reactor chamber 15 is heated to a temperature of about 850° F. and the shaft and blades are caused to rotate at sufficient centrifugal force so that the blades actually ride on the interior surface of the chamber, for example, at speeds of about 50 to 300 rpm. This riding movement minimizes the buildup of carbon, which can serve as an undesirable heat insulator, on the interior walls of the chamber 15.

Heat is transferred evenly from the exterior of the chamber to its interior due to the rotational movement of the blades. Even heat transfer is necessary to insure that the chamber does not develop "hot spots" which would result in the indiscriminate vaporization of radionuclides.

The non-radionuclides begin to vaporize and are removed from the chamber, leaving substantially only Cesium. A reduction in volume of about 90–95 percent is achieved.

Organic material (food products) such as coconut oil is collected in an uncontaminated state. Contamination levels less than typical ambient conditions are achieved.

EXAMPLE II

Low level radionuclide waste from a fission power plant is collected and disposed in the apparatus illustrated in FIGS. 1 and 2. Following the procedure outlined in Example I above, the radionuclides are effectively separated from the non-radionuclides. The interior of the reactor chamber is heated to a temperature high enough to vaporize the non-radionuclides, but not low enough to avoid vaporizing the radionuclides.

Rotational movement and centrifugal force generated within the chamber insures that an even temperature is maintained which does not exceed the vaporization temperature of the radionuclides. The non-radionuclides are vaporized and collected, leaving behind the radionuclides. A reduction in volume of the starting contaminated material of about 90–95 percent is realized.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiment were chosen and described in order to best explain the principles of the invention and its practical application to thereby enable others skilled in the art to best utilize the invention in various embodiments and with various modifications as are suited to the particular use contemplated. For this reason the scope of the invention should be ascertained only with reference to the following claims.

I claim:

1. Apparatus for separating radionuclides from non-radionuclides comprising:

a reactor vessel including wall members defining a reactor chamber adapted to receive a mixture of the radionuclides and non-radionuclides in a solid or liquid phase;

the radionuclides having temperatures of vaporization higher than a first temperature;

the non-radionuclides having temperatures of vaporization lower than a second temperature;

means for heating the mixture in the chamber to a temperature greater than the second temperature but less than the first temperature to drive the non-radionuclides to a vapor phase while retaining the radionuclides in a solid or liquid phase;

means for removing the vapors of the non-radionuclides from the chamber; whereby substantially all of the non-radionuclides exit the chamber in a vapor phase while the radionuclides remain within the chamber in a solid or liquid phase.

2. The apparatus set forth in claim 1 further comprising:

means for capping the reactor vessel with the radionuclides disposed therein to facilitate burial of the radionuclides.

3. The apparatus set forth in claim 1 further comprising:

means for stirring the mixture within the chamber to facilitate even distribution of heat to the mixture; and means for capping the reactor vessel with the radionuclides and at least a portion of the stirring mechanism disposed within the reactor vessel.

4. The apparatus recited in claim 1 further comprising:

means for monitoring the amount of heat being applied to the mixture within the chamber to insure that a heat spike does not develop when the non-radionuclides are fully vaporized.

5. The apparatus recited in claim 4, wherein the monitoring means further comprises:

means for condensing the vapors of the non-radionuclides to provide a flow of condensate indicative of the volume of the non-radionuclides being vaporized;

a sight glass included in the condensing means and through which the flow of condensate can be observed; and means responsive to a reduced flow of the condensate indicative of a depleted volume of the non-radionuclides in the container for reducing the amount of heat applied to the container by the heating means.

6. A method for disposing of radionuclides present in a mixture of non-radionuclides and radionuclides, comprising the steps of:

providing a reactor apparatus including a reactor vessel having wall members defining a reactor chamber;

depositing the mixture of radionuclides and non-radionuclides in the chamber of the reactor vessel, both the radionuclides and the non-radionuclides being in the liquid or solid phase;

transforming the non-radionuclides to a vapor phase while retaining the radionuclides in a solid or liquid phase, within the chamber;

removing the non-radionuclides in the vapor phase from the chamber of the vessel while retaining the radionuclides in the solid or liquid phase within the chamber of the vessel;

separating the reactor vessel from at least a portion of the remainder of the reactor apparatus; and burying the reactor vessel with the radionuclides disposed within the chamber of the reactor vessel.

7. The method recited in claim 6 wherein the mixture consists of a first batch of the radionuclides and non-radionuclides and a second batch of the radionuclides and non-radionuclides, and the method further comprises the steps of:

performing the steps of depositing, placing and removing for the first batch of the mixture;

removing the radionuclides of the first batch of the mixture from the chamber;

repeating the steps of depositing, placing and removing for the second batch of the mixture; and after the separating step, depositing the radionuclides of the first batch of the mixture into the chamber of the vessel.

8. The method recited in claim 6 further comprising the steps providing a stirring mechanism operatively disposed within the reactor chamber;

heating to the mixture within the reactor chamber;

rotating the stirring mechanism to facilitate even distribution of the heat to the mixture within the chamber;

separating the stirring mechanism and the reactor vessel from at least the portion of the remainder of the reactor apparatus; and capping the reactor vessel with the radionuclides and the stirring mechanism disposed within the chamber of the reactor vessel to facilitate disposal of the radionuclides.

9. The apparatus defined in claim 6 wherein the burying step further comprises the steps of:

capping the reactor vessel with the radionuclides disposed therein and without the addition of any other material for stabilizing the radionuclides in the vessel; and burying the vessel with the radionuclides disposed therein.

10. Apparatus for separating radionuclides from non-radionuclides comprising:

a reactor vessel including wall members defining a reactor chamber adapted to receive a mixture of the radionuclides and non-radionuclides;

the radionuclides having a first temperature of vaporization;

the non-radionuclides having a second temperature of vaporization lower than the first temperature of vaporization;

means for heating the mixture in the chamber to a temperature greater than the second temperature of vaporization but less than the first temperature of vaporization;

means for stirring the mixture within the chamber to facilitate even distribution of heat to the mixture;

a plurality of blades included in the stirring means and disposed within the chamber;

a first shaft portion included in the stirring means;

a second shaft portion included in the stirring means and aperatively connected to the first shaft portion and the blades for rotating the blades within the chamber;

means for removing the vapors of the non-radionuclides from the chamber whereby substantially all of the non-radionuclides exit the chamber while the radionuclides remain within the chamber;

means included in the stirring means for separating the second shaft portion from the first shaft portion to facilitate burial of the second shaft portion and the blades within the chamber of the reactor vessel; and means for capping the reactor vessel with the radionuclides and a least a portion of the stirring mechanism disposed within the reactor vessel.

11. Apparatus adapted to receive a mixture of at least two materials including a first material having a temperature of vaporization greater than a first temperature and a second material having a temperature of vaporization less than a second temperature, the second temperature being lower than the first temperature, comprising:

a container defining a chamber for receiving te mixture;

means for heating the mixture in the chamber to a temperature greater than the second temperature but less than the first temperature in order to vaporize the second material but not the first material;

means for condensing the vapor of the second material to produce a flow of condensate having a flow rate indicative of the amount of second material being vaporized; and means responsive to the rate of flow of the condensate in the condensing means for controlling the amount of heat applied to the mixture by the heating means.

12. The apparatus recited in claim 11 further comprising means for purging the chamber of oxygen whereby the second material is vaporized in an oxygen-free environment without combustion.

13. The apparatus recited in claim 11 further comprising:

walls included in the container for defining the chamber and an exit port extending from the chamber outwardly of the container;

means for moving the mixture and the vapor of the second material within the chamber in a first direction relative to the walls of the container;

a deflector baffle fixed to the walls of the container and defining a channel extending in a second direction different than the first direction and terminating over the exit port; whereby the vapor of the second material must move counter to the direction of the mixture in order to exit the chamber thereby inhibiting any possibility of the first material being carried by the vapor exteriorly of the container.

14. A method for separating radionuclides from non-radionuclides comprising the steps of:

providing a container having a wall defining a chamber for receiving a mixture of the radionuclides and the non-radionuclides, the radionuclides having temperatures of vaporization greater than a first temperature and the non-radionuclides having temperatures of vaporization less than a second temperature, the second temperature being lower than the first temperature;

heating the mixture within the chamber to a temperature greater than the second temperature but less than the first temperature, to vaporize the non-radionuclides but not the radionuclides;

exhausting the vapor of the non-radionuclides from the chambe;

condensing the vapor of the non-radionuclides to form a flow of the harmless non-radionuclides; and retaining the radionuclides in the container to facilitate burial of the harmful radionuclides.

15. The method set forth in claim 14 wherein the heating step further comprises the steps of:

heating the wall of the container;

providing a plurality of blades attached to and radiating from a rotatable shaft disposed within the chamber, the blades being in contact with the mixture; and rotating the shaft and the blades to stir the mixture and move the radionuclides and the non-radionuclides against the wall thereby heating the mixture within the container.

16. The method recited in claim 15 further comprising the steps of:

maintaining the blades in contact with the walls; and heating the blades in contact with the walls and imparting the heat in the bades to the mixture at regions spaced from the walls thereby inhancing an even distribution of the heat throughtout the mixture.

17. The method recited in claim 14 further comprising during the condensing step, the steps of:

monitoring the flow of the condensed non-radionuclides to determine when the flow is decreasing to an extent indicative of a low volume of the non-radionuclides within the mixture; and reducing the magnitude of the heat applied to the container during the monitoring and heating step.

18. The method recited in claim 17 further comprising during the monitoring step, the steps of:

providing a sight glass in proximity to the flow of condensed non-radionuclides; and observing a reduced flow of the condensed non-radionuclides through the sight glass.

19. Apparatus adapted to receive a mixture of radionuclides and volatile non-radionuclides, for separating the radionuclides from the non-radionuclides, comprising:

a reactor vessel including wall members defining a reaction chamber;

means for introducing the mixture of the radionuclides and non-radionuclides into the reactor chamber, substantially all of the radionuclides having temperatures of vaporization higher than a first temperature and non-radionuclides having temperatures of vaporization lower than a second temperature, the first temperature being higher than the second temperature;

means for purging oxygen from the reactor chamber;

means for transforming substantially all of the volatile non-radionuclides to vapor state while retaining the radionclides in a solid or liquid state; and means for removing substantially all of the volatile non-radionuclides in the vapor state from the reactor chamber while retaining the radionuclides in the solid or liquid state within the reactor chamber.

20. The apparatus recited in claim 19 wherein the transforming means further comprises;

means for heating the mixture within the reactor chamber;

means disposed within the reactor chamber for centrifuging the mixture to facilitate an even distribution of the heat from the wall members throughout the mixture in the chamber; and means for controlling the temperature of the mixture, for raising the temperature of the mixture to a level above the second temperature, and for maintaining the temperature of the mixture at a level; below the first temperature.

21. The apparatus recited in claim 20 wherein the controlling means further comprises:

means for condensing the vapors of the non-radionuclides to produce a flow of condensate; and means responsive to a reduction in the flow of condensate for lowering the temperature of the heating means in order to maintain the temperature of the mixture at the level below the first temperature.

22. The apparatus of claim 19 wherein the mixture consists essentially of materials in a solid phase.

23. The apparatus of claim 22 wherein the materials in a solid phase include plastic.

24. The apparatus of claim 19 wherein the mixture consists of oxygen-free materials in a liquid phase.

25. The apparatus of claim 24 wherein the materials in a liquid phase include oil.

26. A method for separating a first group of nuclides each having a temperature of vaporization less than a first temperature, from a second group of nuclides each having a temperature of vaporization higher than a second temperature, the first temperature being lower than the second temperature, and the method comprising the steps of:

providing a reactor having a reactor having a reaction chamber;

depositing the first group of nuclides and the second group of nuclides into the reactor chamber, both of the first and second groups of nuclides being in either a liquid phase or a solid phase;

transforming substantially all of the nuclides in the first group into a vapor phase while retaining the nuclides in the second group as a residue in either a liquid phase or a solid phase;

exhausting the nuclides in the first group from the reactor chamber leaving the nuclides in the second group within the reaction chamber; and condensing the vapor of the first group of nuclides exteriorially of the reaction chamber; whereby the first group of nuclides is separated from the second group of nuclides.

27. The method recited in claim 26 further comprising the step of:

purging any inert gases from the reaction chamber prior to the transformation step.

28. The method recited in claim 26 wherein the transformation step comprises the steps of:

heating the nuclides in the reactor chamber in a flame free, oxygen free environment; and controlling the temperature in the reactor chamber so that the nuclides are maintained at a temperature higher than the first temperature but lower than the second temperature.

29. The method recited in claim 26 further comprising the steps of:

performing the foregoing steps for a first batch of the nuclides; removing the residue of the first batch from the reactor chamber;

processing a second batch of the nuclides in the reactor chamber leaving residue of the second batch within the reactor chamber;

loading the residue of the first batch into the reactor chamber; and burying the reactor chamber with the residue of both the first batch and the second batch within the reactor chamber.

* * * * *